United States Patent [19]

Pingston

[11] Patent Number: 5,066,010

[45] Date of Patent: Nov. 19, 1991

[54] BALL DISPENSING MACHINE

[76] Inventor: Mark Pingston, 2425 Lone Tree Rd., Milford, Mich. 48380

[21] Appl. No.: 616,425

[22] Filed: Nov. 21, 1990

[51] Int. Cl.[5] ..... A63B 69/00

[52] U.S. Cl. ..... 273/26 D; 273/29 A; 124/1

[58] Field of Search ..... 273/26 R, 29 A, 26 D, 273/201; 124/50, 81

[56] References Cited

U.S. PATENT DOCUMENTS

| | | | |
|---|---|---|---|
| 2,700,379 | 1/1955 | Brigati | 124/50 |
| 2,955,823 | 10/1960 | Chanko | 273/26 D |
| 3,423,097 | 1/1969 | Fry | 273/201 |
| 3,677,544 | 7/1972 | Meyers et al. | 273/26 D |
| 3,999,753 | 12/1976 | Desilets | 273/29 A |
| 4,021,036 | 5/1977 | Nelson | 273/26 D |
| 4,132,214 | 1/1979 | Schnurr et al. | 124/50 |
| 4,538,810 | 9/1985 | Brophy | 273/26 D |
| 4,676,504 | 6/1987 | Ponza | 273/26 D |
| 4,955,606 | 9/1990 | Leps | 273/26 D |
| 4,981,299 | 1/1991 | Petrillo | 273/201 |

FOREIGN PATENT DOCUMENTS

| | | | |
|---|---|---|---|
| 1110564 | 4/1968 | Fed. Rep. of Germany | 273/201 |
| 48406 | 6/1984 | Fed. Rep. of Germany | 124/50 |
| 926492 | 5/1963 | United Kingdom | 273/26 R |

*Primary Examiner*—Theatrice Brown

*Attorney, Agent, or Firm*—Brooks & Kushman

[57] ABSTRACT

A ball dispensing machine for practicing hitting that includes a carrier mounted on a stand having both a load end and a discharge end. A series of index wheels or a hinged detent operate as a feeder means for feeding differently sized balls from the load end to the discharge end. The stand has a center stanchion comprising a plurality of pieces which are telescopic and rotatable within one another enabling the ball dispensing machine to pivot and be height adjustable allowing for use with various sports and by left-handed and right-handed individuals. The hinged detent enables either hand or foot feeding of the balls. Whereas, the index wheel relies on a motor to control the rate at which balls are delivered.

16 Claims, 1 Drawing Sheet

BALL DISPENSING MACHINE

TECHNICAL FIELD

The present invention is related to the field of ball dispenser devices for hitting practice.

BACKGROUND OF INVENTION

This invention relates to a device enabling an individual to practice striking a ball. Specifically, it relates to an original device for positioning a ball, of any variety, in a position desired by the individual for automatically or manually delivering succeeding balls to the desired position after each ball is struck by the individual.

Various types of ball dispensing devices have previously been developed such as pitching machines, T-batting machines and toss-batting machines. Such a device is presented in U.S. Pat. No. 4,548,407 to Sato which discloses a gravity-fed ball tossing device which feeds a sequence of balls at spaced intervals. The device relies on a series of levers and a meandering track to control the speed and interval of the balls released but is not adapted to dispense the differently sized balls of a variety of sports.

U.S. Pat. No. 4,538,810 to Brophy discloses a baseball dispensing device for practicing batting which includes a tubular chute for retaining and delivering baseballs to the hitter. A pair of rotating discs with holes which rotate perpendicular to the tubular opening allow balls to alternatively enter the central delivery chute. A contact spring is located at the distal end of the delivery chute which is flexed by the weight of the moving baseball projecting the baseball upward for a distance. The size of the dispensing device and the tubular delivery chute limit the variety of the balls which may be used.

U.S. Pat. No. 4,021,036 to Nelson et al. discloses a tennis teaching machine having a ball hopper slideably mounted on a vertical support. A hollow extension arm protrudes from the ball hopper having a ball projection mechanism located at its distal end. A rotating ball tray supported within the ball hopper supplies balls to the extension arm of the ball projection mechanism. An automated feeder is connected to a tape deck controlling the rate of delivery of the balls. This reliance on an automated feeder, the size of the ball hopper and extension arm limit the versatility of the unit. The size of the dispensing device and the tubular delivery chute limit the variety of the balls which may be used.

U.S. Pat. Nos. 2,955,823 and 2,955,824 to Chanko disclose a gravity-fed adjustable batting practice device for discharging balls from a magazine under the control of the batter. A runway or guide projects from the magazine discharging balls along a path which simulates that of a pitched ball passed through the strike zone of the batter. The batter is required to depress the free end of the wire runway to release a ball. Therefore, the size of the dispensing device and the tubular delivery chute limit the variety of the balls which may be used.

DISCLOSURE OF INVENTION

It is an object of the present invention to provide a ball dispensing machine capable of adjustment for use with a variety of ball sizes, sports and individuals.

The invention provides a ball dispensing machine of simple construction having a stand comprising a base and a multiple-pieced stanchion. The pieces within the stanchion are both fictionally slidable and rotatable enabling the device to be both height adjustable and pivotal allowing the device to be very versatile. A carrier is mounted on the stand having both a load end and a discharge end. The carrier is positioned so as to bias balls in the carrier toward the discharge end. The carrier has an open top and insertable guide bars so as to be adaptable to different sized balls. A feeder means for feeding balls from the load end to the discharge end operates in conjunction with a control means for controlling the speed of the feeder means. The control means is either a motor controlling the rate of rotation of the index wheel or a pull motor operating in co-operation with a spring to control the gate means. The gate means comprises either a series of index wheels sized to correspond to various ball sizes, each having one or a plurality of blades allowing balls to be fed at a variable rate, or a hinged detent enabling the balls to be fed either by hand or foot lever.

Accordingly, it is an object of the present invention to provide a highly adjustable ball dispensing machine which may be used for a variety of sports and by a variety of individuals Another object of the present invention is to provide a ball dispensing machine which has a variety of index wheels which in turn have a variety of blades to accommodate a large variety of balls which can be released at any desired rate.

A further object of the present invention is to provide a ball dispensing machine having a carrier with an open top allowing the device to accommodate a large variety of ball sizes.

A specific object of the present invention is to provide a ball dispensing machine for use with a variety of sports. The invention has a stand with a base and a stanchion. A carrier having a load end and a discharge end, is mounted on the stand. The carrier is located so as to bias balls toward the discharge end. A feeder means operates in conjunction with a control means for controlling the speed of the balls to be released.

The invention, together with additional features and advantages thereof may best be understood by reference to the following description taken in connection with the accompanying illustrative drawings.

BEST MODE FOR CARRYING OUT INVENTION

Figure 1:
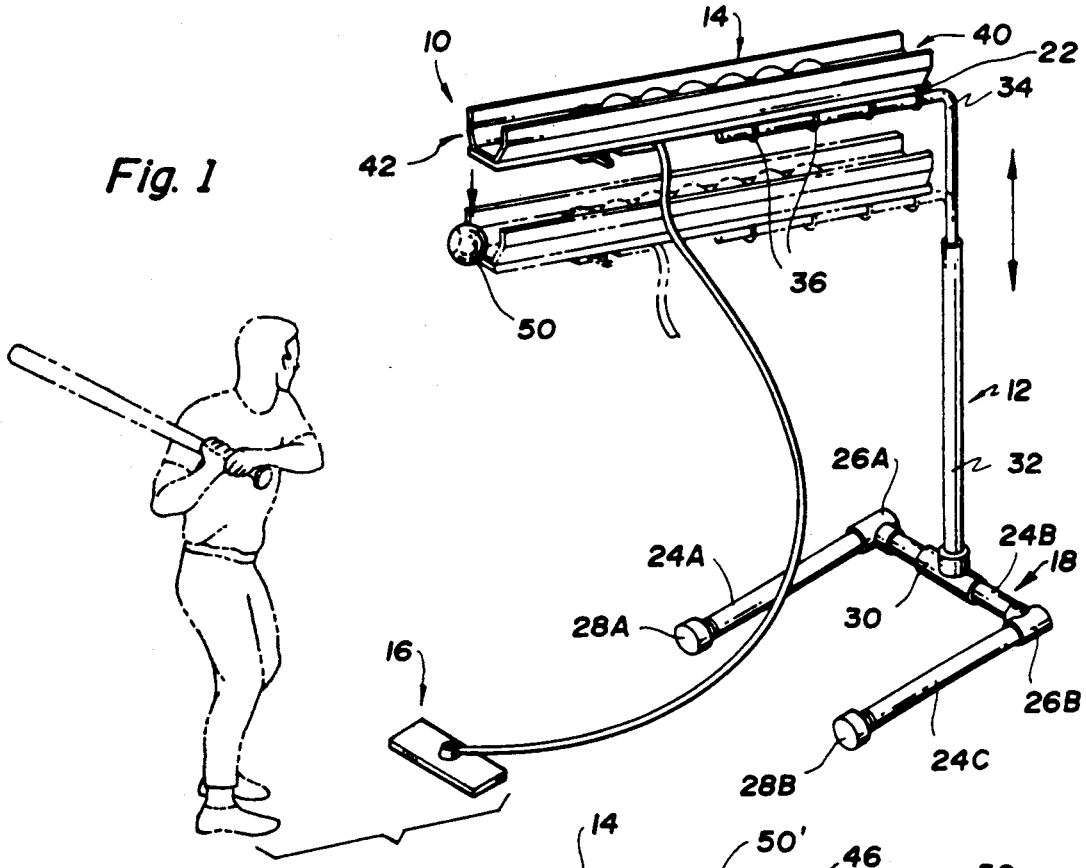
FIG. 1 is a perspective view of the invention showing the invention in operation with a lowered position shown in phantom.

Referring to FIGS. 1 through 6, FIG. 1 illustrates a ball dispensing machine, generally indicated at 10, including a stand, generally indicated at 12 and a carrier, generally indicated at 14. The embodiment depicted in FIG. 1 shows a foot pedal, generally indicated at 16 to control the delivery of a ball 50.

The stand 12 comprises a base 18, a stanchion 20 and a platform 22. The base 18 is a plurality of pieces, in this embodiment ¾" piping, assembled in a generally U-shaped configuration. Three pipes 24A, 24B and 24C are connected by two joints 26A and 26B to form the U-shaped base 18. End caps 28A and 28B cover the free ends of pipes 24A and 24B

A joint 30 centrally located on pipe 24B connects the stanchion 20 to the base 18. The stanchion 20 is of two piece construction having a first member 32 attached to the joint 30 and having a second member 34 which is telescopic and rotatable within the first member 32 enabling the ball dispensing machine to be height adjustable and rotatable allowing for use by both left and right-handed individuals.

The second member 34 is generally L-shaped to provide the carrier 14 adequate clearance from the base 18 and the stanchion 20. The second member is oriented such that the discharge end of the carrier is lower than the load end to control the feeding of balls from the load end to the discharge end. The platform 22 is interposedly attached between the stanchion 20 and the carrier 14 by means of fasteners 36.

The carrier 14 is generally a U-shaped trough having a load end 40 and a discharge end 42. A hole 44 is centrally, located at the discharge end 42 of the carrier 14 to enable the index wheel 46 or a detent 48 to feed the ball 50 at the desired speed to the discharge end.

Figure 2:
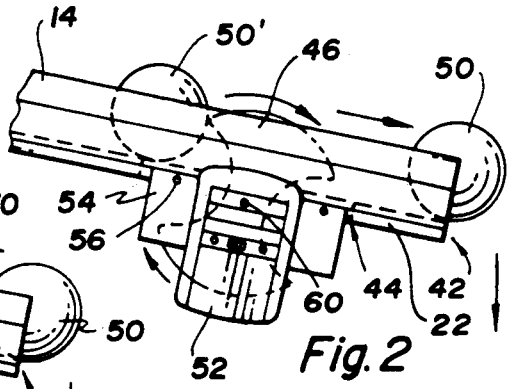
FIG. 2 is a fragmentary view of the control means and an index wheel showing the operation of the index wheel.

FIGS. 2 and 3 and FIGS. 5 and 6 depict indicated different embodiments of the ball dispensing machine 10 wherein each different embodiment is given a different prime designation with the same reference numeral indicating the same or similar structure common to the different embodiments FIG. 2 illustrates a carrier 14 of the ball dispensing machine 10 having a motor 52 controlling the speed of the index wheel 46 which feeds the ball 50 at the desired rate. The index wheel 46 is a generally circular disk with two cutouts on opposing sides matched to fit the size of the ball 50 to be used., giving the index wheel 46 a shape resembling the head of a double-blade axe.

Figure 4:
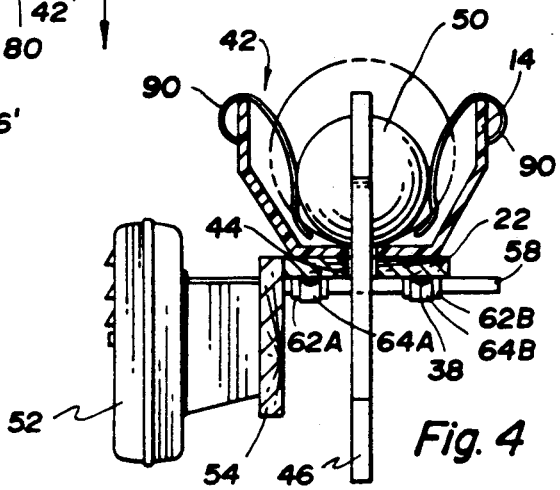
FIG. 4 is an end view of the embodiment shown in FIG. 2 showing the control means operating in co-operation with an index wheel.

Referring to FIGS. 2 and 4, a mounting plate 54 is interposedly mounted parallel to the side of the carrier 14 between the platform 22 and the motor 52. The mounting plate is fastened by screws, bolts or the like, generally indicated at 56, to both the platform 22 and the motor 52. The motor 52 is attached to the mounting plate 54 such that the motor 52 longitudinally extends away from and is parallel with the carrier 14.

The ball 50 is picked up in one of the cutouts in index wheel 46 as it turns on drive rod 58 which cooperates with a centrally located hole 60 in the index wheel 46 matched to accommodate the drive rod 58 which in turn is connected to the motor 52. The motor 52 determines the speed at which the drive rod 58 turns thereby controlling the rate at which the ball 50 will be delivered to the discharge end 42 of the carrier 14 because the drive rod 58 turns the index wheel 46 at the rate set by the motor 52. The drive rod 58 is held in place by two hollow guides 62A and 62B which in turn are attached to the platform 22 by means of brackets 64A and 64B. Guide bars 90 are removable wire which can be placed on the carrier 14 to bias smaller balls toward the center of the carrier 14 to ensure smoother operation of the gate means.

Figure 3:
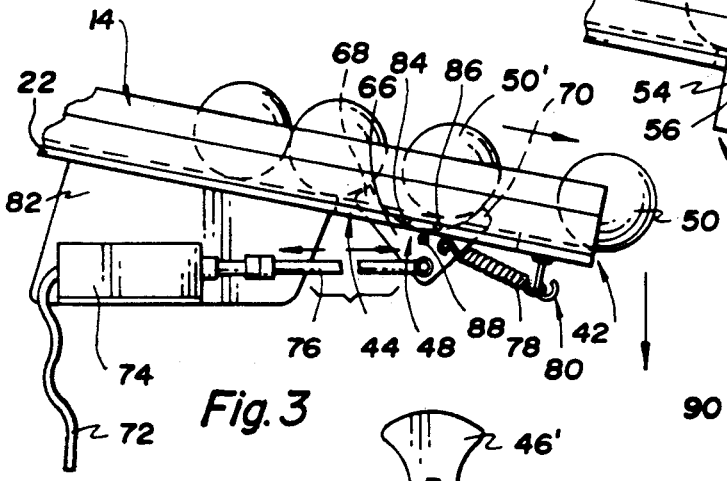
FIG. 3 is a fragmentary view similar to FIG. 2 showing an alternative embodiment of this invention.

FIG. 3 shows the ball dispensing machine 10 using a detent 48 rather than the index wheel 46 to control the delivery of the ball 50. The generally V-shaped detent 48 is inserted into the hole 44' such that in the neutral position, the detent 48 prevents the ball 50 from reaching the discharge end 42 of the carrier 14. The detent 48 is situated such that the ball 50 sits in a cradle 66 of the detent 48 between two arms of the detent 48, 68 and 70 respectively.

In operation, the foot pedal 16 is depressed which causes tension to be placed on a cable 72 activating a 12V pull motor 74 which pulls on a rod 76 interposedly coupled between the detent 48 and the pull motor 74. The rod 76 when pulled, causes one arm 68 of the V-shaped detent 48 to retract into the hole 44' allowing the ball 50 to be discharged, while causing the other arm 70 of the detent 48 to project above the hole 44' preventing another ball 50' from being discharged. A spring 78 is attached to the detent 48 by means of a fastening hook 80 threadedly attached to the underside of the platform 22. The spring 78 is attached to the detent 48 in direct opposition to the rod 76 such that at release, as the rod 76 pulls the detent 48 down, the spring 78 is stretched. Once the ball 50 is discharged, the pull motor 74 is de-activated allowing the spring 78 to recoil causing the detent 48 to return to the neutral position allowing a new ball 50' to be fed into the cradle 66 of the detent 48. A mounting plate 82 is fastened to the underside of the platform 22. The pull motor 76 is attached to the same side of the mounting plate 82 as the detent 48 by fasteners or the like. Pins 84 and 86 are located in the hole 44' such that the pins 84 and 86 restrict the upward movement of the arms 68 and 70 respectively in the hole 44'. The pins 84 and 86 are press-fitted into matching slots cut into the sides of the hole 44 in the carrier 14 such that the pins 84 and 86 are parallel to each other and are perpendicular to the longitudinal direction of the hole 44'. The detent 48 pivots around a center pin 88 attached to the underside of the platform by brackets (not shown) similar to brackets 64A and 64B which secure the drive rod 58.

Figure 5:
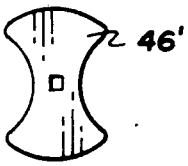
FIG. 5 is a top view of a smaller index wheel as shown in FIGS. 2 and 4.
Figure 6:
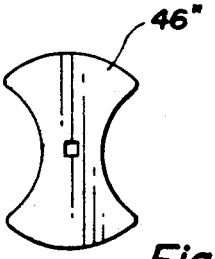
FIG. 6 is a top view similar to FIG. 5 showing a larger index wheel as shown in operation in FIGS. 2 and 4.

FIGS. 5 and 6 illustrate other sizes of the index wheel 46' and 46'' respectively which can be substituted to operate with different sized balls.

Although the best mode for carrying out the invention has been described in detail, those familiar to the art to which this invention relates will recognize various alternative designs and embodiments for practicing the invention as defined by the following claims.

What is claimed is:

1. A ball dispensing machine for use with differently sized balls of a variety of sports, the ball dispensing machine comprising:

a stand having a base and a stanchion;

an inverted U-shaped, open top ball carrier mounted on said stanchion, removable guide bar means mounted on each leg of said U-shaped carrier to selectively accommodate differently sized balls, a load end and a discharge end;

said open top being continuous from said load end to said discharge end;

the carrier having means for feeding balls in said carrier toward the discharge end;

gate means for controlling said feeding of balls from said load end to said discharge end; and a control means for operating said gate means to feed said balls at a desired rate.

2. The ball dispensing machine of claim 1 wherein the stanchion is telescopic for vertical and rotatable adjustment to accommodate use by different individuals and different sports.

3. The ball dispensing machine of claim 1 wherein said further comprises said stanchion has an elbow portion for projecting said carrier sufficiently away from said base to ensure adequate clearance from said base for a user.

4. The ball dispensing machine of claim 1 wherein said carrier includes a platform supporting said carrier thereof and connecting said carrier to said stanchion.

5. The ball dispensing machine of claim 4 wherein said connection of said platform to said stanchion includes spaced brackets mounted to said platform by fastening means.

6. The ball dispensing machine of claim 1 wherein said guide means for use with balls of smaller size bias such balls toward said center of said carrier.

7. The ball dispensing machine of claim 1 wherein said gate means comprises an index wheel having cutouts sized to correspond to balls of different sizes in accordance with the selective accommodation of said guide bar means.

8. The ball dispensing machine of claim 1 wherein said gate means comprises an index wheel having cutouts, the number of which co-operate with said control means to feed balls at a desired rate.

9. The ball dispensing machine of claim 1 including a platform and further comprising a hole in said carrier located toward said discharge end to accommodate said gate means.

10. The ball dispensing machine of claim 1 wherein said control means comprises a motor attached to one end of a pivot rod, said gate means being an index wheel attached to the other end of said pivot rod to feed the balls at said desired rate.

11. The ball dispensing machine of claim 1, wherein said motor moves said means in one direction and a spring fixedly attached to and between said gate means and said carrier moves said gate means in the opposite direction.

12. The ball dispensing machine of claim 9 wherein the control means includes a motor attached to one end of a rod to move said gate means in one direction and a spring fixedly attached at one end thereof to said gate means and having its other end fixedly attached to said carrier to move the gate means in the opposite direction.

13. The ball dispensing machine of claim 1 wherein the control means includes a motor and a foot pedal to control operation of said motor for causing balls to be discharged at a desired rate.

14. The ball dispensing machine of claim 1 wherein the gate means includes a detent having a plurality of limbs and a cradle interposedly between said limbs for holding the ball to be discharged.

15. The ball dispensing machine of claim 14 wherein said carrier further includes a hole and a plurality of retention pins interposedly located across the hole to restrict upward movement of the limbs.

16. The ball dispensing machine of claim 1 wherein said carrier includes a platform for supporting the U-shape carrier thereof and connected to the stanchion and said detent further includes a pivot pin rotatably affixed to said platform enabling said detent to pivot.

* * * * *